US009138033B2

(12) United States Patent
Kojima et al.

(10) Patent No.: US 9,138,033 B2
(45) Date of Patent: Sep. 22, 2015

(54) TOP STOP FOR SLIDER

(71) Applicant: YKK CORPORATION OF AMERICA, Marietta, GA (US)

(72) Inventors: Yoshinori Kojima, Toyama (JP); Shigeyoshi Takazawa, Macon, GA (US); John E. Holliday, Jr., Macon, GA (US)

(73) Assignee: YKK Corporation (JP)

( * ) Notice: Subject to any disclaimer, the term of this patent is extended or adjusted under 35 U.S.C. 154(b) by 252 days.

(21) Appl. No.: 13/803,249

(22) Filed: Mar. 14, 2013

(65) Prior Publication Data

US 2014/0259560 A1 Sep. 18, 2014

(51) Int. Cl.

| | |
|---|---|
| ***A44B 19/26*** | (2006.01) |
| ***A44B 19/24*** | (2006.01) |
| ***A44B 19/36*** | (2006.01) |
| ***A44B 19/32*** | (2006.01) |

(52) U.S. Cl.

CPC ..... *A44B 19/26* (2013.01); *A44B 19/24* (2013.01); *A44B 19/32* (2013.01); *A44B 19/36* (2013.01); *Y10T 24/2511* (2015.01); *Y10T 24/2513* (2015.01); *Y10T 24/2514* (2015.01); *Y10T 24/2561* (2015.01); *Y10T 24/2593* (2015.01); *Y10T 24/2598* (2015.01)

(58) Field of Classification Search

CPC .... A44B 19/301; A44B 19/303; A44B 19/32; A44B 19/36; A44B 19/26; A44B 19/24; Y10T 24/2511; Y10T 24/2513; Y10T 24/2593; Y10T 24/2598; Y10T 24/2561; Y10T 24/2514

USPC ..... 24/388, 436, 433, 389

See application file for complete search history.

(56) References Cited

U.S. PATENT DOCUMENTS 2,923,992 A * 2/1960 Armstrong et al. ..... 24/389
3,409,953 A * 11/1968 Briscoe ..... 24/389

(Continued)

FOREIGN PATENT DOCUMENTS

CN 101380160 A 3/2009
EP 1992243 B1 2/2011

(Continued)

OTHER PUBLICATIONS

International Patent Application No. PCT/US2012/047333, International Search Report and Written Opinion mailed Oct. 18, 2012 (5 pages).

(Continued)

*Primary Examiner* — Robert J Sandy

(74) *Attorney, Agent, or Firm* — Kilpatrick Townsend & Stockton LLP

(57) ABSTRACT

A top stop made of a flexible material that cooperates with at least a portion of a slider body. The top stop includes a body having a fin that extends upwardly from the body and that includes a contour that generally conforms to a leading edge of the slider body. In some versions, the top stop has a gap that is configured to snuggly receive a connecting neck of the slider body in such a way that water is prevented from penetrating the slider body. In some embodiments, the top stop includes two extensions, at least one of which has one or more sliding surfaces that are configured so that the slider assembly produces an audible noise when the connecting neck is snuggly received within the gap and the assembly is in the locked position.

14 Claims, 16 Drawing Sheets

(56) References Cited

U.S. PATENT DOCUMENTS

| | | | | |
|---|---|---|---|---|
| 3,505,710 | A | 4/1970 | Froehlich | |
| 4,232,431 | A | 11/1980 | Akashi | |
| 4,524,493 | A | 6/1985 | Inamura | |
| 4,825,514 | A | 5/1989 | Akeno | |
| 5,253,395 | A | 10/1993 | Yano | |
| 7,591,051 | B2 | 9/2009 | Kusayama et al. | |
| 2005/0204516 | A1* | 9/2005 | Leva et al. | 24/385 |
| 2007/0067969 | A1* | 3/2007 | Kusayama et al. | 24/436 |
| 2007/0074380 | A1 | 4/2007 | Matsumoto | |
| 2009/0019675 | A1 | 1/2009 | Peano | |
| 2014/0137375 | A1* | 5/2014 | Tanaka et al. | 24/389 |
| 2014/0157555 | A1 | 6/2014 | Takazawa | |
| 2015/0000087 | A1* | 1/2015 | Tanaka et al. | 24/389 |

FOREIGN PATENT DOCUMENTS

| | | | |
|---|---|---|---|
| GB | 2199616 | A | 7/1988 |
| JP | S51-035204 | A | 9/1949 |
| JP | S63-103411 | A | 7/1975 |
| JP | S58-181209 | A | 12/1983 |
| JP | 6313689 | | 4/1988 |
| JP | 53050 | | 1/1993 |
| JP | H05-001307 | A | 1/1993 |
| JP | 2003-180412 | A | 7/2003 |
| JP | 2008-284358 | A | 11/2008 |
| TW | I309157 | | 5/2009 |
| WO | 2013013007 | A1 | 1/2013 |

OTHER PUBLICATIONS

"International Preliminary Report on Patentability", International Patent Application No. PCT/US2012/047333, mailed Jan. 30, 2014.

Office Action, Japanese Patent Application No. 2014-520414, mailed Mar. 24, 2015.

Office Action, Taiwanese Patent Application No. 101126383, mailed Jul. 14, 2014.

Written Opinion, PCT Application No. PCT/US2012/047333, mailed Oct. 18, 2012.

* cited by examiner

TOP STOP FOR SLIDER

RELATED APPLICATIONS

This application is related to U.S. Ser. No. 13/186,814 filed Jul. 20, 2011, now abandoned, the contents of which are incorporated herein by reference.

FIELD OF THE INVENTION

Top stops for interfacing with at least portions of a slider body of a slider.

BACKGROUND

A slider typically consists of a slider body and a pull tab. When the slider is pulled to one end of a tape, it contacts a component referred to as the "top stop" of the tape. A cover may be used to prevent water from entering any gaps that exist between the top stop and the slider. However, such a cover is an additional part and therefore requires extra time and expense for installation. As an alternative, the top stop may cooperate with a custom slider that has an enlarged top wing and an enlarged bottom wing, with the two enlarged wings extending over the connecting neck connecting the two wings. Portions of the enlarged wings overlap with the top stop and help eliminate any gaps between the slider and the top stop, thus helping to reduce the possibility for water to flow between the slider and the top stop. However, this configuration requires a custom-made slider, which increases costs.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Disclosed are improved top stops configured to interface with standard sliders to form a positive lock between the top stop and the slider that eliminates any gaps between the top stop and the standard slider. The cooperation of the improved top stop and the standard slider thus prevents water from penetrating through any gaps between the slider and the top stop. In some embodiments, when the slider is locked in position with respect to the top stop, an indication (such as an audible sound) is provided. In some versions, the top stop is made of a flexible material and cooperates with at least a portion of a slider body. The top stop comprises a body having a fin that extends upwardly from the body and that includes a contour that generally conforms to a leading edge of the slider body. In some versions, the top stop comprises two extensions that project from the body and a gap that is configured to snuggly receive a connecting neck of the slider body in such a way that water is prevented from penetrating the slider body. In some embodiments, at least one of the two extensions has one or more sliding surfaces that facilitate the locking of the top stop with respect to the slider and that are configured to provide the indication that the slider has been locked with respect to the top stop.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different figures is intended to illustrate like or analogous components.

DETAILED DESCRIPTION

Figure 1:
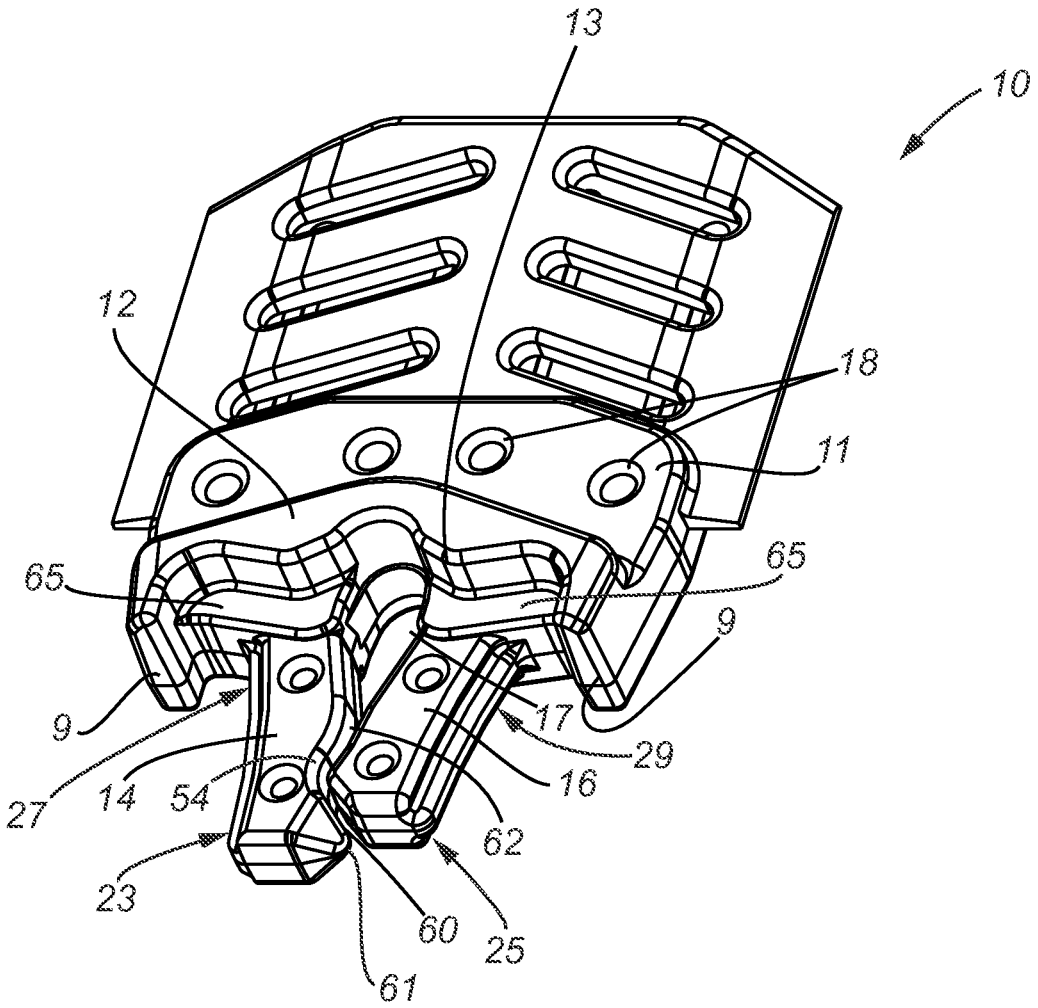
FIG. 1 is an isometric top view of a top stop according to one embodiment.
Figure 2:
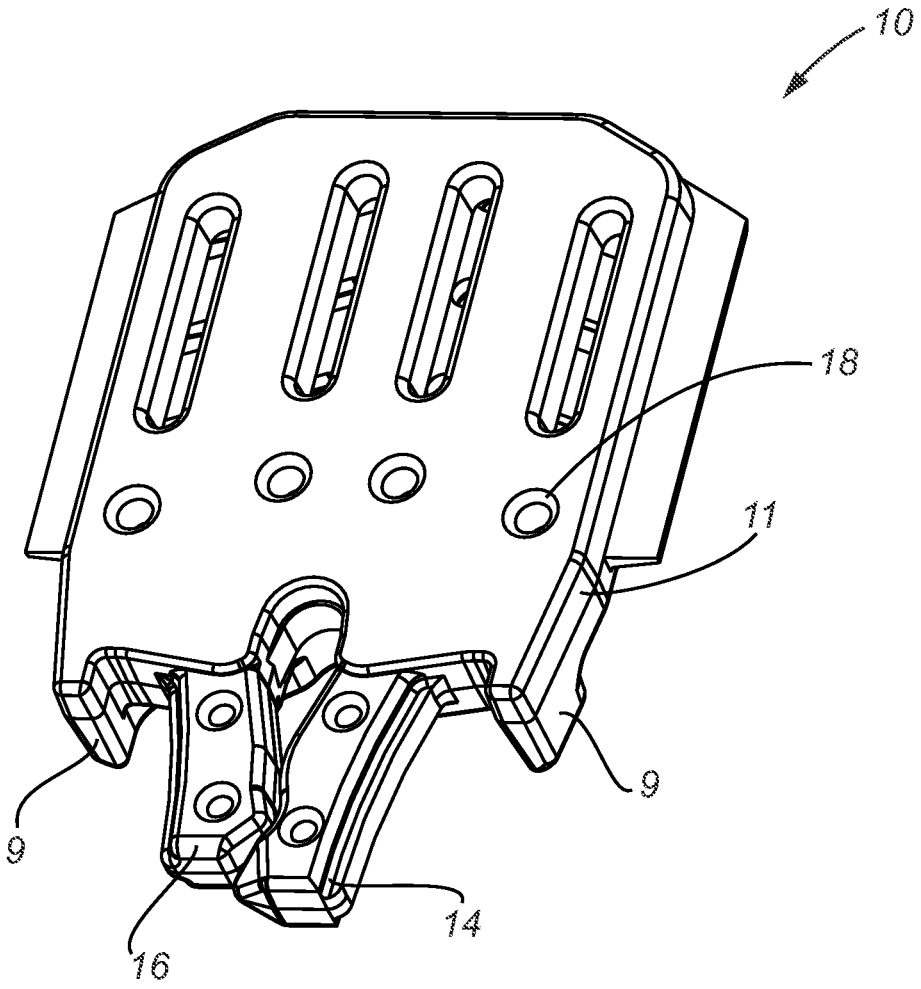
FIG. 2 is an isometric bottom view of the top stop of FIG. 1.

Disclosed are improved top stops for use with sliders. Top stop 10 illustrated in FIGS. 1-4 is configured to cooperate with a conventional slider body, such as but not limited to slider body 20 shown in FIGS. 5-8, to limit the traversal of the slider along a tape, such as tape 50 shown in FIG. 9. In addition, top stop 10 is configured to engage with the slider body to form a slider assembly that does not have any gaps between the top stop and portions of the slider body so that water is prevented from penetrating the slider assembly. Slider assembly refers to a top stop 10 positioned with respect to the slider body 20.

As is known, a slider body cooperates with elements (such as elements 52 shown in FIGS. 9-14 and 16-17) located on opposite sides of tape (such as tape 50 shown in FIGS. 9-13) to open and close a zipper. A slider typically includes a slider body, such as slider body 20, and a pull tab (not shown) that attaches to the slider body in a known manner. When the slider is moved in one direction, a generally Y-shaped channel (such as guide channel 44 shown in FIG. 8 and located between a top wing (such as wing 30) and a bottom wing (such as wing 32)) of the slider body meshes together rows of opposing elements 52 of the tape. When the slider is moved in the opposite direction, the generally Y-shaped channel and the connecting neck of the slider body separates the rows of opposing elements 52.

Figure 9:
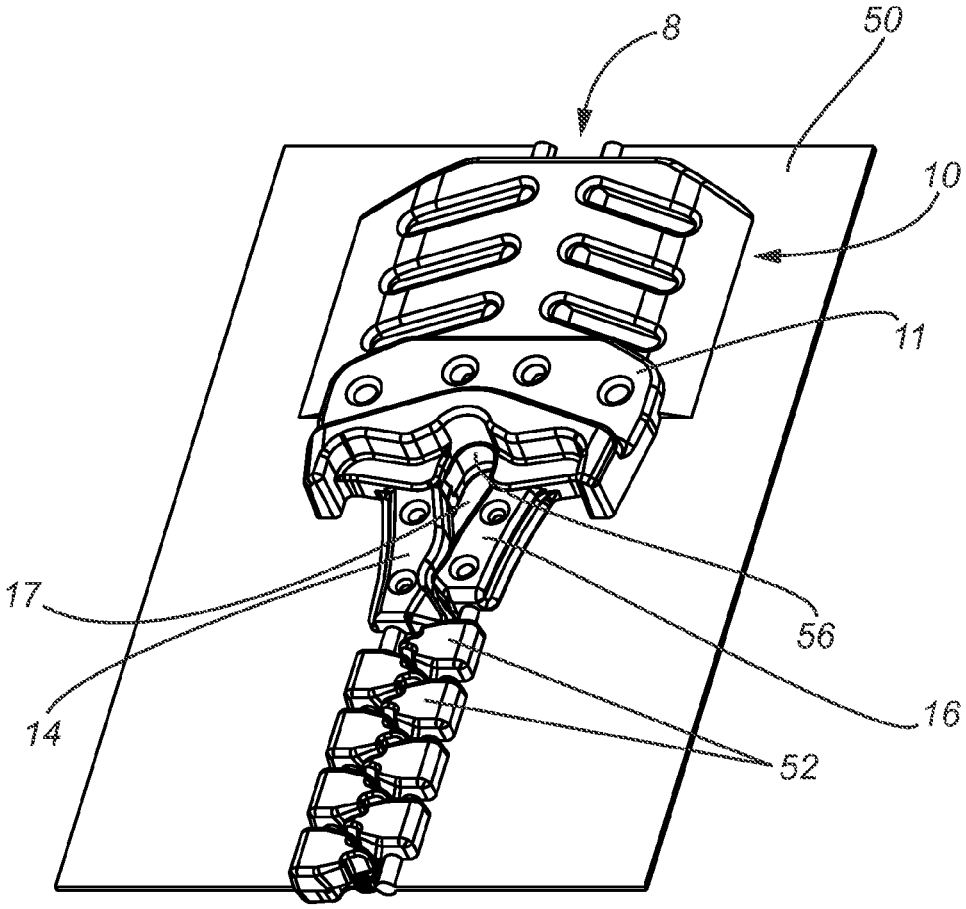
FIG. 9 is an isometric top view of the top stop of FIG. 1 engaged with a tape and elements, shown with the top stop in the disengaged position.
Figure 13:
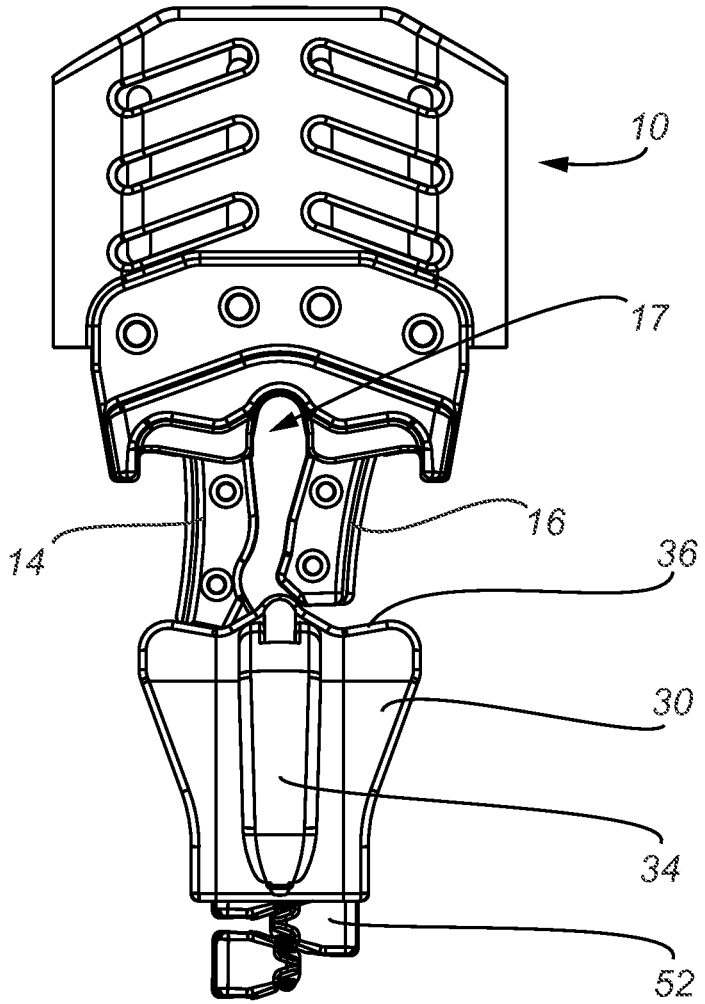
FIG. 13 is a top plan view of the top stop of FIG. 1 positioned with respect to the elements of FIG. 9 and with respect to the slider of FIG. 5, shown as the top stop begins to interact with the connecting neck of the slider.

As shown in FIGS. 9 and 13, the top stop 10 may be connected to the tape 50 such that the two sides of the tape 50 are positioned relatively close to one another so that they are separated by a small gap 8. In some embodiments, the sides of the tape 50 are connected at one or both of the ends of the tape using a top and bottom stop, such that the tape is not separable.

Figure 10:
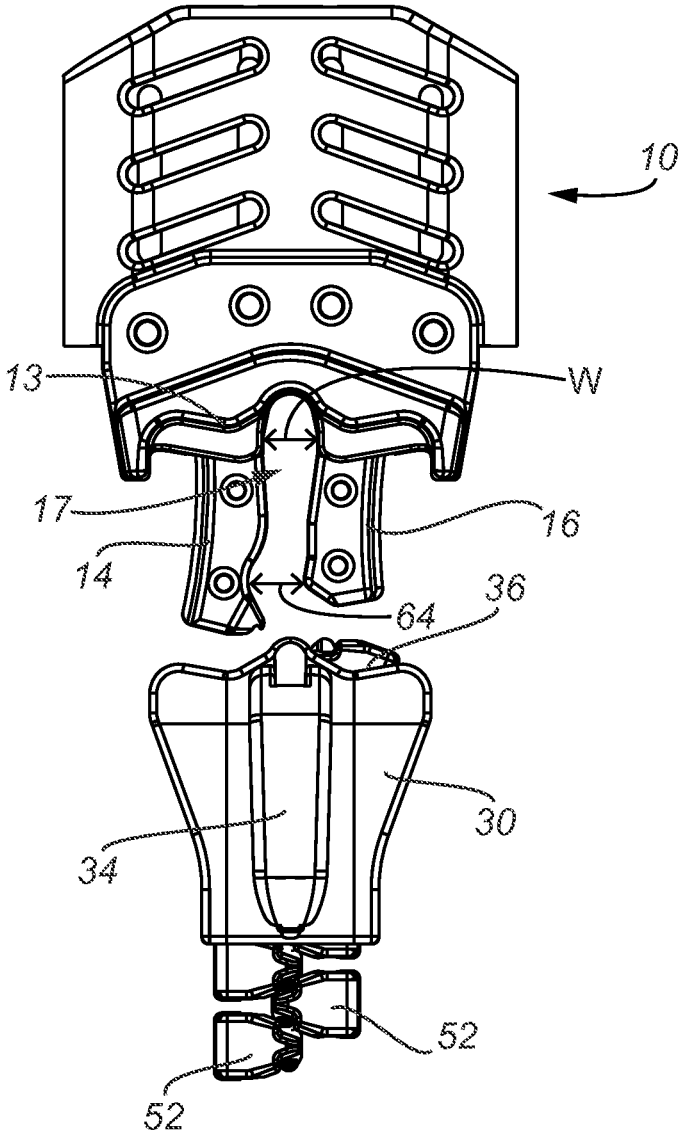
FIG. 10 is a top plan view of the top stop of FIG. 1 and the slider of FIG. 5 engaged with the elements of FIG. 9, shown with the top stop and the slider positioned with respect to one another.
Figure 11:
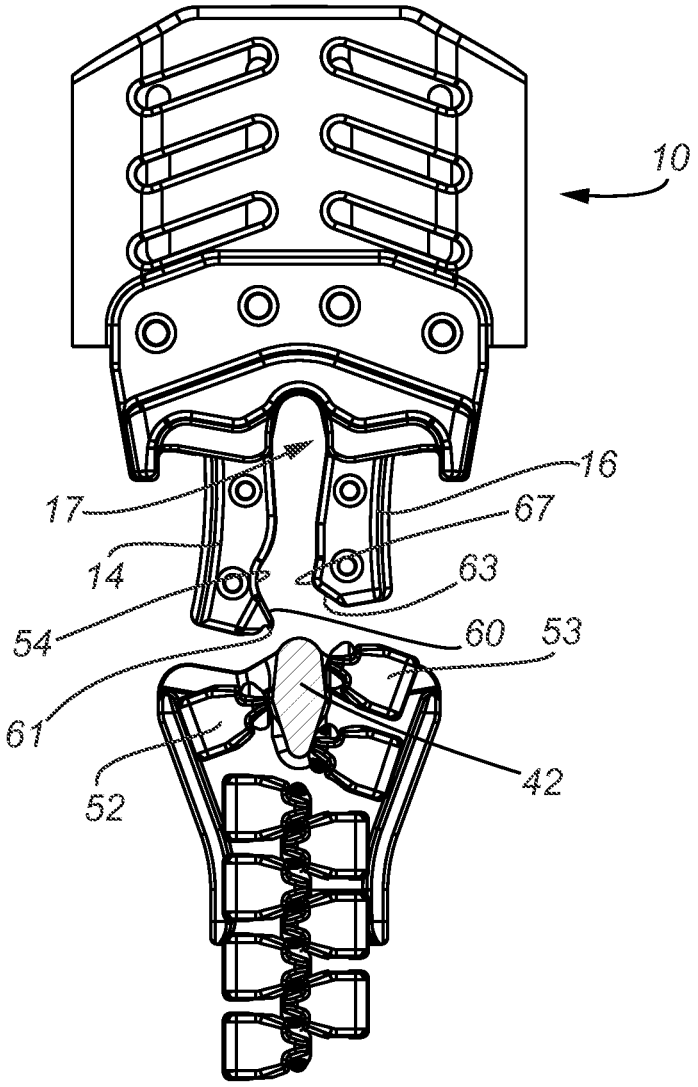
FIG. 11 is a top plan view of the top stop of FIG. 1 positioned with respect to the elements of FIG. 9 and with respect to a cutaway view of the slider of FIG. 5.

When the top stop 10 is fully engaged with the slider body 20 such that the top stop 10 forms a positive lock with the slider body 20, the assembly is referred to as being in the engaged position (and sometimes, the top stop by itself is referred to as being in the engaged position). When in the engaged position (FIGS. 16-17), the top stop 10 forms a water resistant seal with the slider body 20, as explained in more detail below. When the top stop is completely disengaged from the slider body 20 such that the slider body 20 is not in contact with the top stop and is separated from the top stop by a sufficient number of elements, the assembly is referred to as being in the disengaged position (and sometimes, the top stop by itself is referred to as being in the disengaged position). The transition of the assembly from the disengaged to the engaged position is explained in detail below. In some embodiments, as the slider body 20 approaches the top stop 10, but is not yet in contact with the top stop 10, the slider assembly is referred to as transitioning/moving from the disengaged position into the engaged position (such as shown in FIGS. 10-11), and not necessarily as being in the disengaged position. FIGS. 12-15 show other views of the slider assembly as it transitions into the engaged position.

Figure 7:
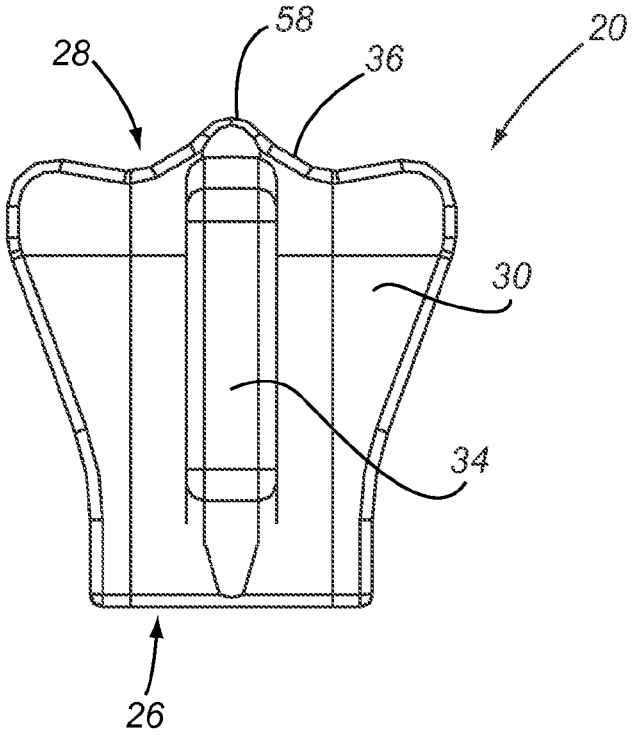
FIG. 7 is a top plan view of the slider of FIG. 5.
Figure 8:
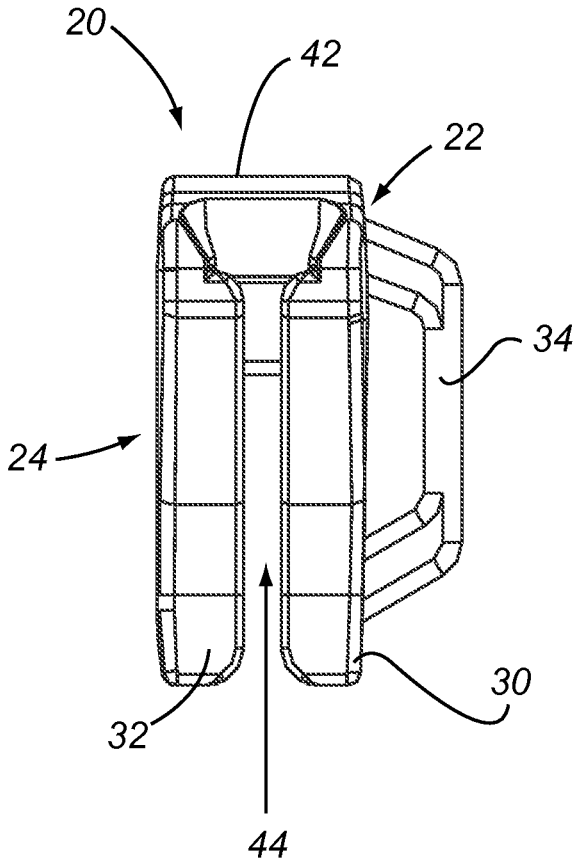
FIG. 8 is a side plan view of the slider of FIG. 5.

Top stop 10 is typically attached to the tape at one of the ends of the tape, which as explained above, is non-separable in some embodiments. In some embodiments, top stop 10 is attached to the tape above the elements 52. As shown in FIGS. 7-8, slider body 20 has a top 22, a bottom 24, and a front 28. Slider body 20 includes a top wing 30 and a bottom wing 32 that are spaced apart from one another and joined at the front 28 by a connecting neck 42 (sometimes referred to as a diamond) to form a generally Y-shaped guide channel 44. The connecting neck 42 includes a leading portion 58 (FIG. 7). Crown 34, around which a pull tab can be pivotably received, protrudes from the top wing 30 of the slider body 20. Slider body 20 can be of conventional construction so that the top and bottom wings are generally similar in shape and size, although they need not be. Moreover, the top and bottom wings may be configured so they do not extend beyond the connecting neck 42, as shown in FIG. 8, for example.

FIGS. 1-4 illustrate a top stop 10 according to one embodiment. Top stop 10 has a body 11 that may be formed of any suitable material, such as plastic or other relatively soft, flexible material. In some versions, top stop 10 is formed of silicone or polyurethane materials. If formed of silicone, the silicone material may have a shore durometer of around 25 to around 100 on the ASTM D2240 Type A scale. If formed of polyurethane, the polyurethane material may have a shore durometer of around 20 to around 95 on the ASTM D2240 Type A scale. Moreover, the polyurethane material may have a shore durometer of around 30 to around 90 on the ASTM D2240 Type D scale.

Figure 3:
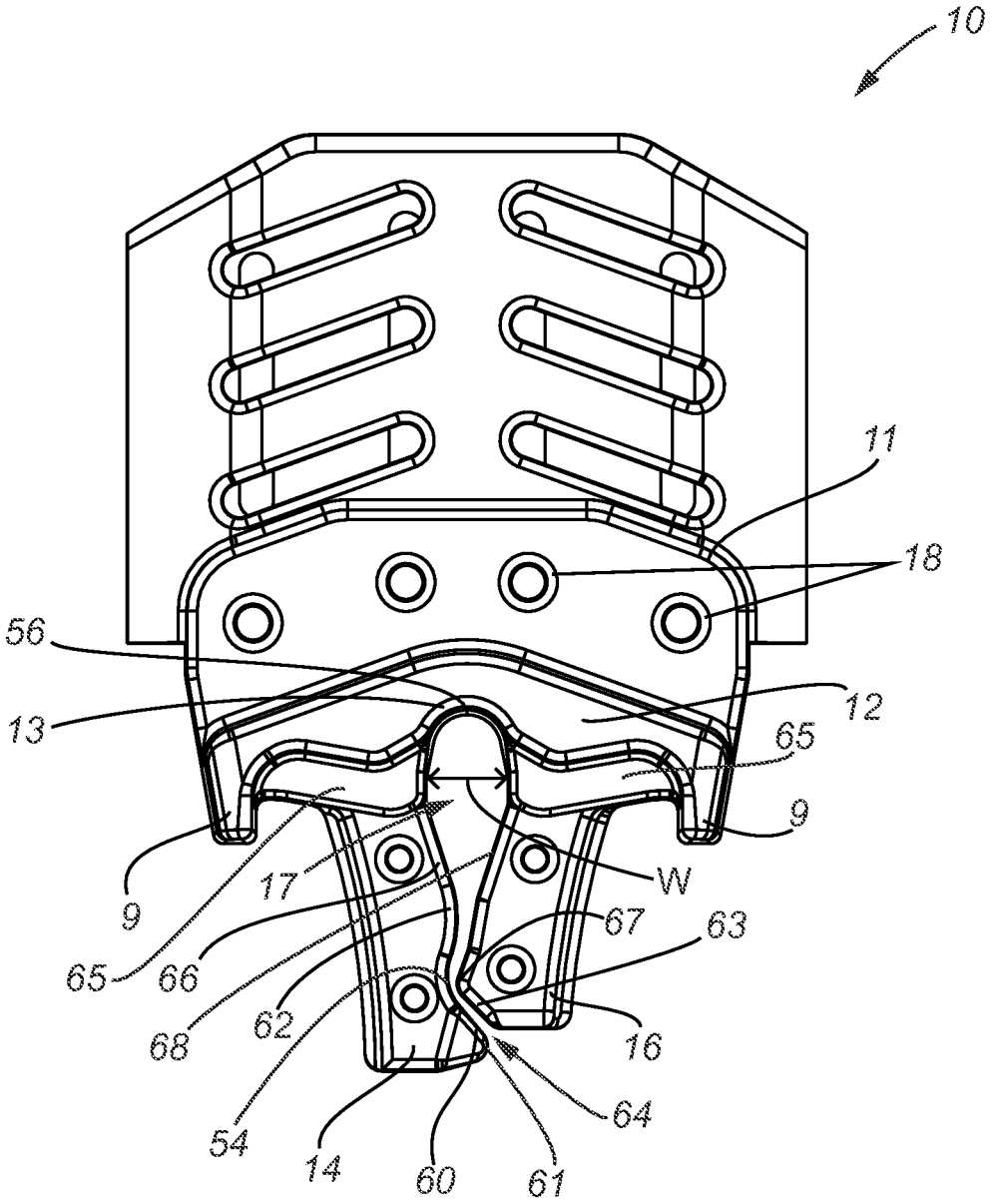
FIG. 3 is a top plan view of the top stop of FIG. 1.
Figure 4:
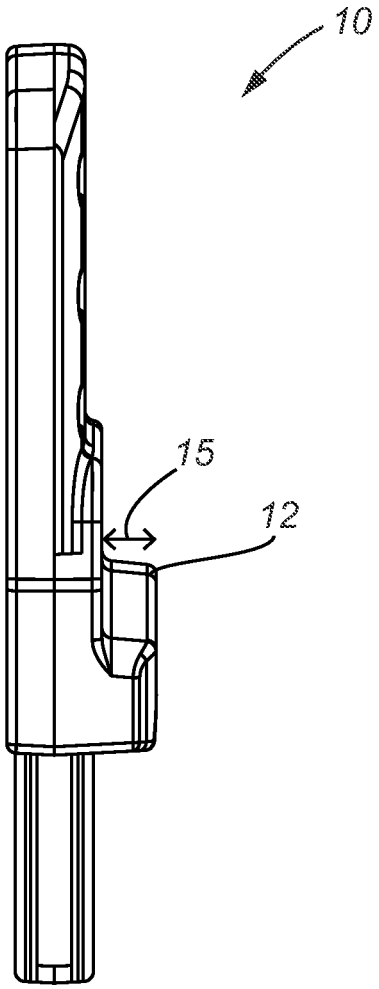
FIG. 4 is a side plan view of the top stop of FIG. 1.
Figure 5:
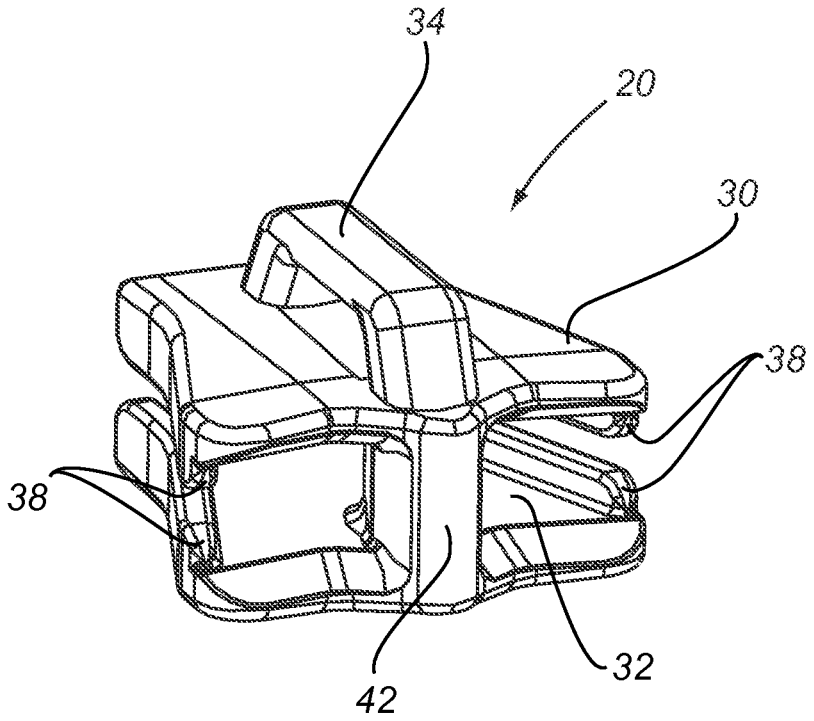
FIG. 5 is a front isometric view of a conventional slider.
Figure 6:
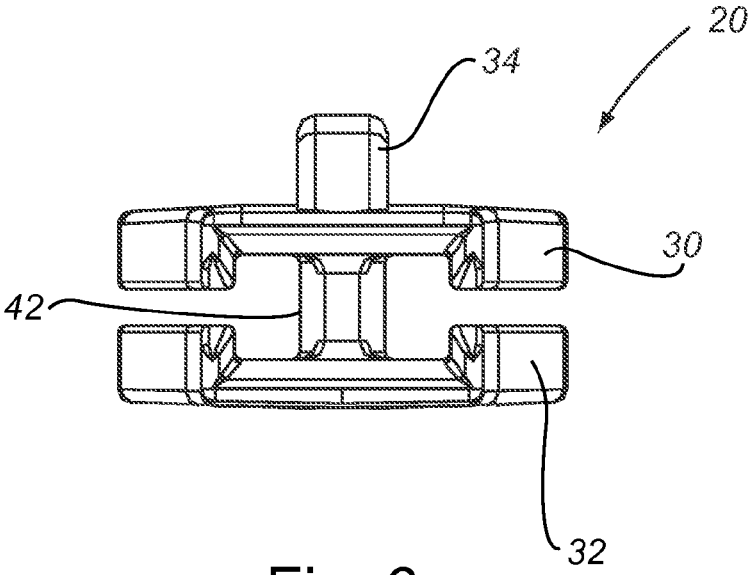
FIG. 6 is a rear plan view of the slider of FIG. 5.

As shown in FIGS. 1-4, top stop 10 includes a fin 12 that projects generally upward from the body 11. As illustrated in FIG. 4, fin 12 may project upwardly from body 11 by a dimension 15. In some versions, as shown in FIGS. 1 and 3, the fin 12 is a raised ridge that extends generally from the left to the right side of top stop 10 and directs water toward the edges of the top stop 10 and away from the slider body 20 when the top stop 10 is engaged with the slider body 20. In some embodiments, the fin 12, like the body 11 of the top stop 10, is formed of a flexible material and in some embodiments is also relatively thin to increase its flexibility. The fin 12 includes a contour 13 (FIGS. 1, 3, 10) that generally conforms to the leading edge 36 of the slider body 20 (FIGS. 7, 10, 13). Specifically, the contour 13 is profiled to accommodate the leading portion 58 of the connecting neck 42 and to accommodate the other parts of the front 28 of the top wing 30 (or the bottom wing 32 in other embodiments) of the slider body 20. The top stop 10 also includes one or more ledges 65 that are profiled and dimensioned to be received within and fill any space between the wings 30, 32 of the slider body and the tape. Because contour 13 generally tracks the leading edge 36 of the slider body 20, including the leading edge 58 of the connecting neck 42 of the slider body 20, and because the ledges 65 are profiled and dimensioned to fill any space between the wings 30, 32 and the tape, water is restricted from penetrating the assembly.

As shown in FIGS. 1 and 3, a gap 17 is formed in the top stop 10, with the gap being shaped and dimensioned to accommodate the connecting neck 42 of the slider body 20. In some embodiments, the profile and dimensions of gap 17 mirror the profile and dimensions of the connecting neck 42 so that connecting neck 42 is snuggly received within gap 17 when the slider assembly is in the engaged position. In some embodiments, the gap 17 is sized/toleranced so it is slightly bigger than the connecting neck 42.

As shown in FIG. 1, an upper portion of the gap 17 is formed between the ledges 65 and a lower portion of gap 17 is formed between the inner edge of proximal end 27 of a first extension 14 and the inner edge of proximal end 29 of a second extension 16, where both projections project from the body 11 of the top stop 10. Gap 17 includes a lip 56 (shown in FIGS. 3 and 9), which the leading portion 58 of the connecting neck 42 of the slider body 20 abuts when the slider assembly is in the engaged position. In some embodiments, lip 56 is formed of a relatively thin, flexible material that can be compressed when the connecting neck 42 abuts it, and is thus configured to accommodate variations in the size/shape of the connecting neck 42. Moreover, the compression of lip 56 around connecting neck 42 ensures a tight, water resistant seal between the top stop 10 and the connecting neck 42.

Figure 16:
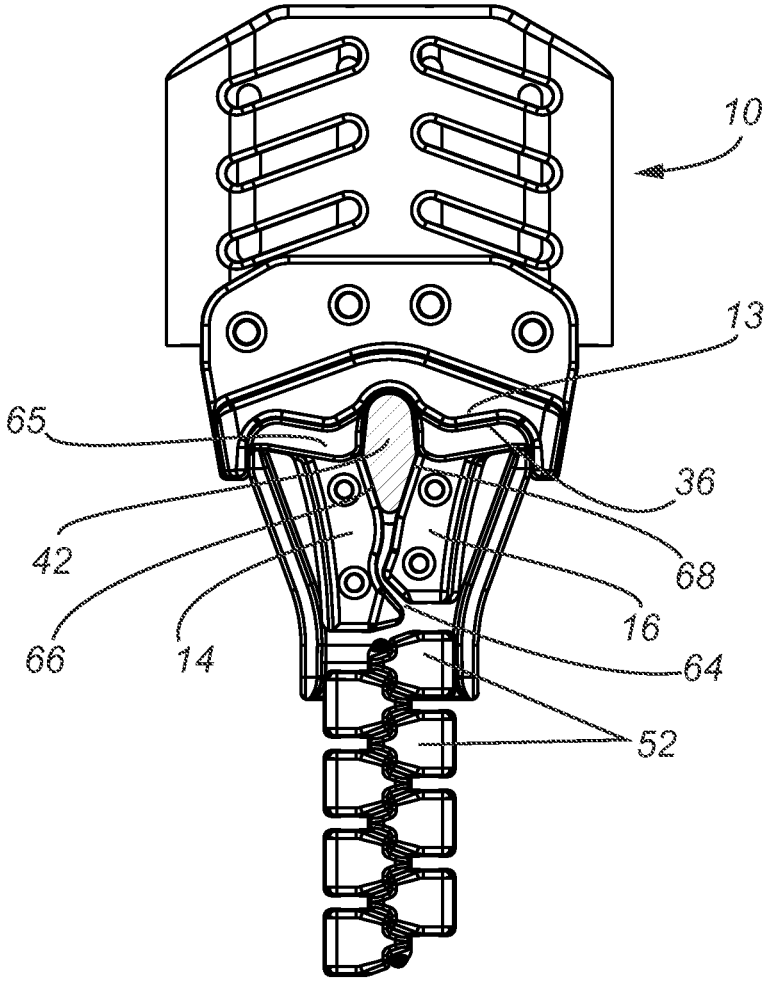
FIG. 16 is a top plan view of the top stop of FIG. 1 positioned with respect to the elements of FIG. 9 and with respect to a cutaway view of the slider of FIG. 5, shown with the top stop in the engaged position.
Figure 17:
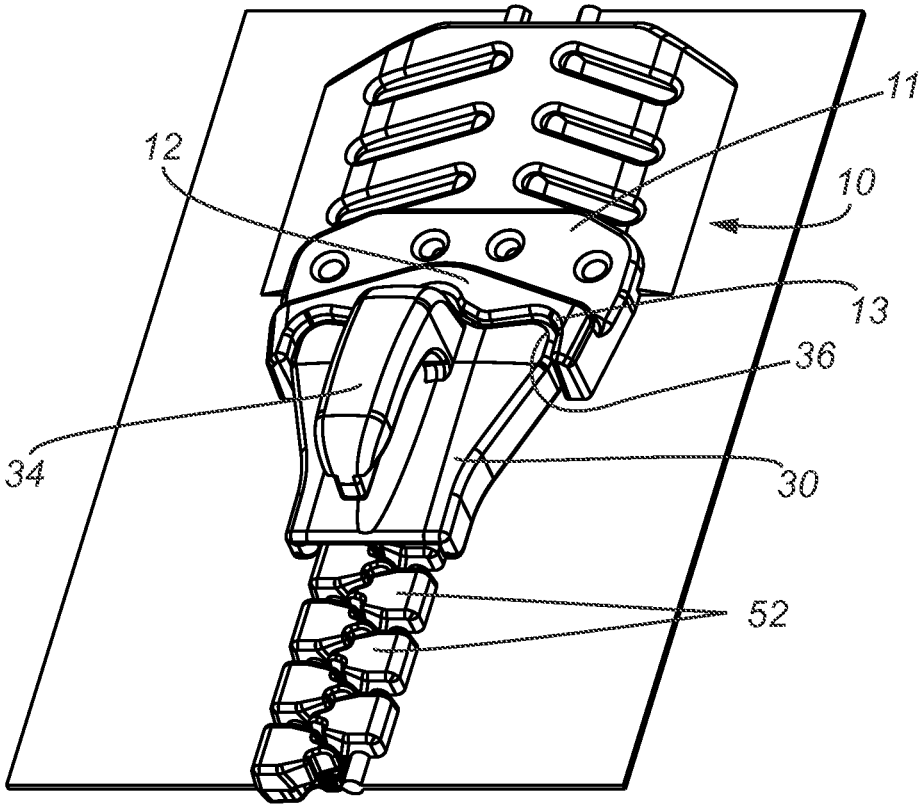
FIG. 17 is an isometric top view of the top stop of FIG. 1 positioned with respect to the tape of FIG. 9 and with respect to the slider of FIG. 5, shown with the top stop in the engaged position.

As shown in FIG. 11, when top stop 10 is engaged with a tape (although the tape itself is not shown in FIG. 11), first extension 14 is positioned with respect to an element 52, while second extension 16 is positioned with respect to another element 53. Although as illustrated, first extension 14 projects further downwardly than an edge of second extension 16, it is envisioned that second extension 16 could project further downwardly than a edge of first extension 14, depending on the configuration of the elements 52 of the tape 50 (for example, if the tape and elements were reversed from that shown in the Figures). In general, the amount of projection of each of the extensions 14, 16 depends on the positioning of the elements 52, 53. In some embodiments, extensions 14, 16 project downwardly such that their distal ends 23, 25 (FIG. 1) extend past the gap 17 and, when the slider assembly is in the engaged position as shown in FIGS. 16-17, past the connecting neck 42. In some embodiments, extensions 14, 16 do not contact elements 52, but project toward them.

FIG. 9 illustrates the top stop 10 in the disengaged position, where the slider body 20 does not contact the top stop 10 and the slider body 20 is separated from the top stop 10 by a sufficient number of elements 52. In this disengaged position, extensions 14 and 16 project toward one another at their distal ends 23, 25 so that only a very small space 64 (FIG. 3) is present between them at their distal ends. In some embodiments, when in the disengaged position, the width of the space 64 between the two extensions is smaller than the width W of the gap 17 (FIG. 3). Similarly, when the slider is in the fully engaged position, as shown in FIGS. 16-17 when the connecting neck 42 is received within the gap 17 and compresses lip 56, extensions 14 and 16 project toward one another at their distal ends 23, 25 so that only a very small space 64 is present between them at their distal ends. In some embodiments, when in either the engaged or disengaged position, the width of the space 64 between the two extensions is smaller than the width W of the gap 17. In some embodiments, the width of the space 64 is substantially the same when the slider assembly is in either the disengaged position or the engaged position, while the width of the space 64 as the slider assembly transitions between the disengaged and engaged positions (FIGS. 10-15) is greater than when the slider assembly is in either the disengaged or engaged position.

In particular, as shown in FIGS. 10-15, as the slider assembly transitions from its disengaged to engaged position, the width of the space 64 between the distal ends of the extensions 14, 16 increases as the distal ends 23, 25 of the extensions separate from one another. In some embodiments, as the slider body 20 approaches the top stop 10 but is separated from the top stop 10 by at least one uncoupled element 52, as shown in FIGS. 10-11, the slider assembly is considered to be moving from its disengaged to engaged position such that the width of the space 64 between the distal ends of the extensions 14, 16 is greater than the width of this space 64 when the slider assembly is in either the disengaged or engaged position. In some embodiments, the width of the space 64 while the slider assembly transitions between the disengaged and engaged positions (FIGS. 10-15) is substantially the same as or slightly narrower than the width W of gap 17. In some embodiments, having the width of the space 64 be slightly less than the width W of the gap 17 helps retain the connecting neck 42 within the gap 17 as the slider assembly makes its final transition into the engaged position (FIGS. 16-17). Moreover, sliding surface 66 (shown in FIG. 3 and explained in detail below) and sliding surface 68 (FIGS. 3 and 16) help keep the connecting neck 42 fully engaged within gap 17 even after a user no longer applies force to the slider body 20. As stated above, once the slider assembly is in the fully engaged position (FIGS. 16-17), the width of the space 64 is smaller than the width W of the gap 17 to help retain the connecting neck 42 within the gap 17.

Figure 12:
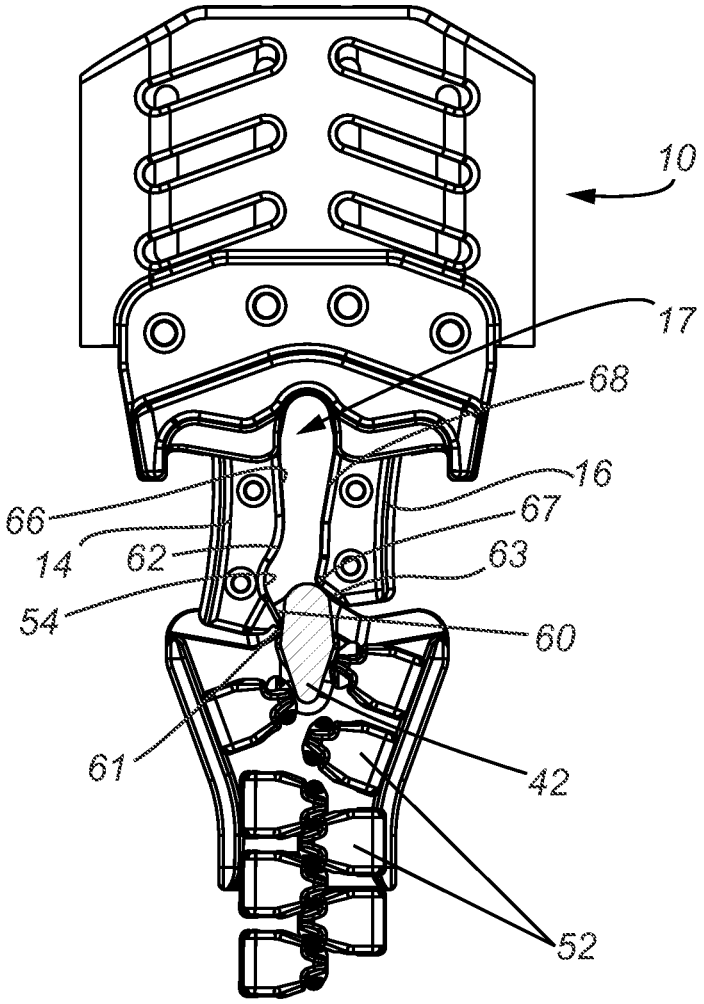
FIG. 12 is a top plan view of the top stop of FIG. 1 positioned with respect to the elements of FIG. 9 and with respect to a cutaway view of the slider of FIG. 5, shown as the top stop begins to interact with the connecting neck of the slider.

As shown in FIGS. 1 and 3, at least one of the extensions (such as but not limited to first extension 14 as illustrated in the Figures) includes one or more sliding surfaces, such as sliding surfaces 60 and 62. Sliding surfaces 60 and 62 may be generally planar, wedge-like surfaces configured to provide increased resistance along portions of first extension 14 of top stop 10 as the connecting neck 42 of the slider body encounters the sliding surfaces 60, 62 as the slider assembly transitions from the disengaged position into the engaged position and vice versa. In some embodiments, a bend 54 is provided between sliding surfaces 60, 62. As shown in FIGS. 11-12, second extension 16 includes at least one sliding surface 63 and at least one edge 67 configured to provide resistance as it contacts the connecting neck 42 as the slider assembly transitions from the disengaged position into the engaged position and vice versa.

FIGS. 12-13 illustrate the connecting neck 42 of the slider body 20 as it engages edge 61 of first extension 14, first sliding surface 60 of the first extension 14, and sliding surface 63 of second extension 16 and as the connecting neck 42 separates first extension 14 from second extension 16 to widen the space 64 between the two extensions at their distal ends 23, 25. The configuration of the first sliding surface 60 and/or edge 61 and/or sliding surface 63 is such that the connecting neck 42 encounters resistance when it contacts the first sliding surface 60 and/or the edge 61 and the sliding surface 63. As such, sufficient force is required to move the slider body 20 past the edge 61 and/or first sliding surface 60 and past sliding surface 63 toward the engaged position. In some embodiments, sliding surface 63 of second extension 16 and/or edge 67 (FIGS. 3, 14) is configured to help guide the connecting neck 42 towards bend 54 and second sliding surface 62.

Figure 14:
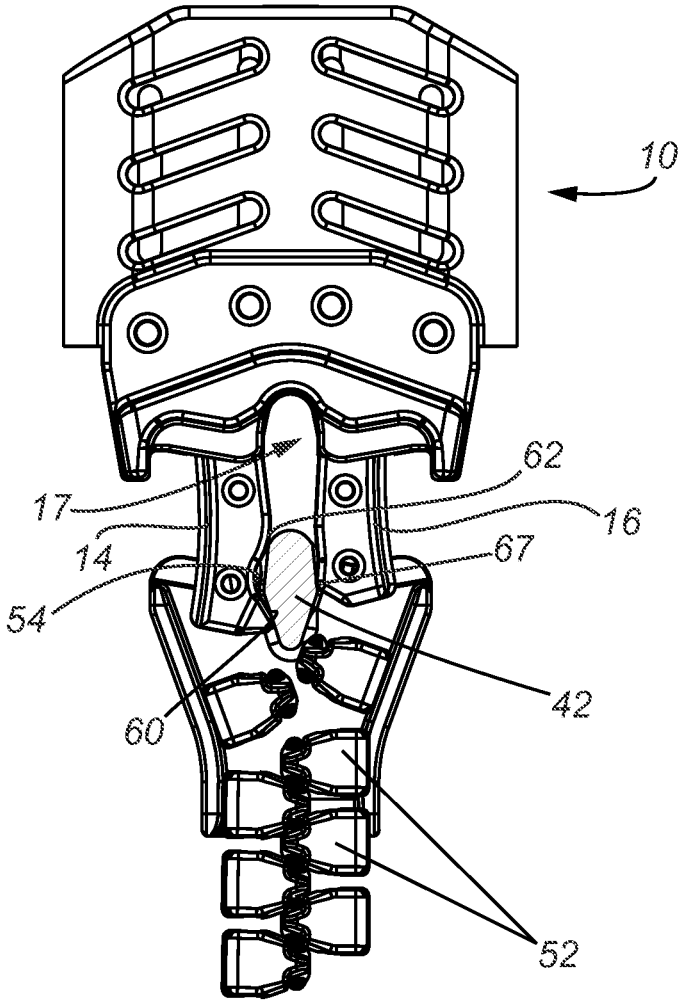
FIG. 14 is a top view of the top stop of FIG. 1 positioned with respect to the elements of FIG. 9 and with respect to a cutaway view of the slider of FIG. 5, shown as the top stop continues to interact with the connecting neck of the slider.
Figure 15:
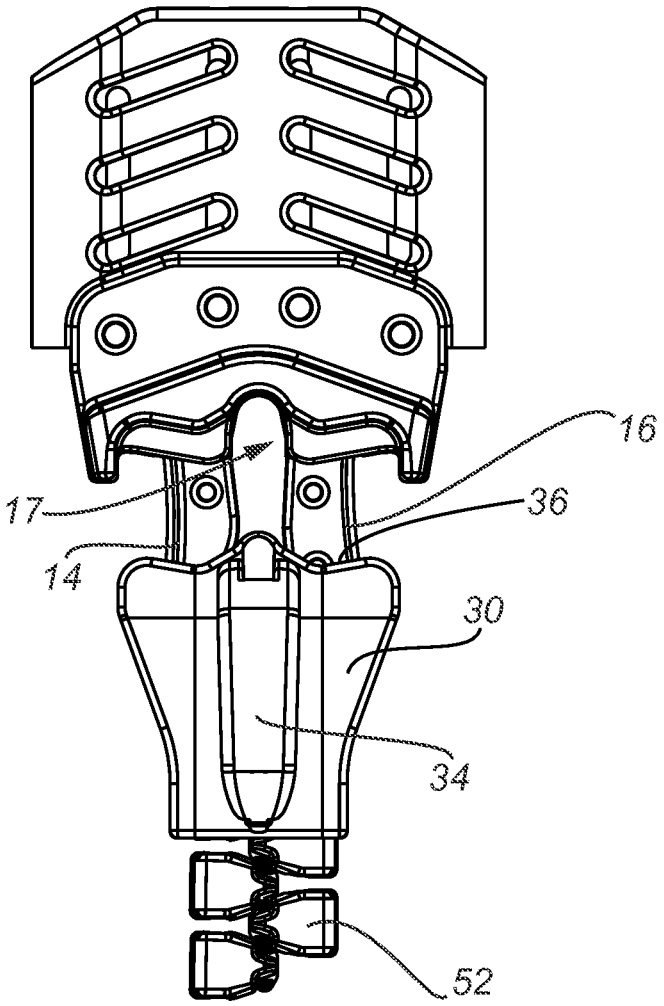
FIG. 15 is a top plan view of the top stop of FIG. 1 positioned with respect to the elements of FIG. 9 and with respect to the slider of FIG. 5, shown as the top stop continues to interact with the connecting neck of the slider.

Once sufficient force is supplied to overcome the resistance generated between the connecting neck 42 and each of the first sliding surface 60 and the sliding surface 63, the connecting neck 42 of slider body 20 slides past the first sliding surface 60 and engages the bend 54 and/or the second sliding surface 62 of the first extension 14 as illustrated in FIGS. 14-15. In some embodiments, the slope of second sliding surface 62 is greater than the slope of first sliding surface 60 and the slope of sliding surface 63 so that more resistance is generated between the connecting neck 42 and the second sliding surface 62 and/or the bend 54 than the resistance generated between the connecting neck 42 and the first sliding surface 60, edge 61, and sliding surface 63. In this way, in some embodiments, second sliding surface 62 (and/or bend 54) is configured so that it generates much of the resistance that the connecting neck 42 experiences as the slider assembly moves into its engaged position.

As with the first sliding surface 60, edge 61, and sliding surface 63, the configuration of the second sliding surface 62 and/or the bend 54 is such that sufficient force is required to overcome the resistance generated between the connecting neck 42 and the second sliding surface 62 and/or the bend 54 and move the slider body 20 past the bend 54 and past the second sliding surface 62 into the slider assembly's engaged position. In some embodiments, the bend 54 serves as a change in direction from sliding surfaces 60, 62 such that additional resistance is generated as connecting neck 42 moves past the bend 54 and into gap 17.

As stated above, the sufficient force to overcome the resistance generated between the connecting neck 42 and the bend 54 and the second sliding surface 62 and move the slider body 20 past the bend 54 and the second sliding surface 62 may be greater than the sufficient force required to move the slider body 20 past the first sliding surface 60. Once sufficient force is supplied, the slider body 20 gathers momentum as it moves past the bend 54 and along the second sliding surface 62 until the connecting neck 42 is received snuggly within gap 17 and the slider assembly is in its engaged position. In some embodiments, another sliding surface 66 (FIGS. 3, 12 and 16) and another sliding surface 68 (FIGS. 3 and 16) mirrors the shape of at least a portion of the connecting neck 42 so that, when the slider assembly is in the engaged position, at least a portion of the connecting neck 42 abuts the sliding surfaces 66 and 68, although this need not be the case.

As the slider assembly moves past the bend 54 and along the second sliding surface 62 into its engaged position, the distal ends 23, 25 of the first and second extensions 14, 16 move back toward one another so that only small space 64 is again present between them (see FIG. 16), with such small space being similar in width to the small space 64 that is present between the distal ends 23, 25 of the extensions 14, 16 when the slider assembly is in the disengaged position.

Contemporaneous with the slider assembly locking in the engaged position, an indication is provided (such as an audible snapping or other sound), informing a user of the slider assembly that the slider assembly is in the fully engaged position such that a positive lock is formed between the top stop 10 and the slider body 20. In some embodiments, the audible snapping sound is caused because the sufficient force required to move the slider body 20 past the sliding surfaces 60, 62, 63 and edges 61, 67 generates momentum such that the connecting neck 42 contacts the lip 56 and/or such that the front 28 of slider body 20 contacts the lip 56 with sufficient force to produce an audible sound. In some cases, the force needed to overcome the resistance generated between the connecting neck 42 and the second sliding surface 62 due to the configuration of the second sliding surface 62 as described above especially causes a "snap" sound once the slider body 20 and the connecting neck 42 contact the lip 56 of the top stop 10 and the top wing 30 of the slider body 20 contacts the contour 13 on the fin 12.

It is envisioned that the configuration of extensions 14, 16 may vary such that the connecting neck 42 contacts alternate points or surfaces of one or more of the extensions as the slider assembly transitions between the disengaged and engaged positions. Along these lines, the sliding surfaces of the extensions are not limited to the particular arrangement described and illustrated, but can be modified in any suitable way such that a snapping sound or other indicator (such as a feeling of "give" associated with overcoming a sufficient amount of resistance) is provided as the connecting neck 42 is received within the gap 17 and the assembly is in the engaged position.

For example, the curvature/radius of bend 54 can be adjusted so that more or less resistance is generated between bend 54 and connecting neck 42. Similarly, the slope of sliding surfaces 60, 62, and 63 can be increased to generate more resistance between these surfaces and connecting neck 42 or decreased to generate less resistance.

As shown in FIG. 1, top stop 10 also includes two projections 9 that project from the body 11 and accommodate the flange 38 (FIG. 5) of the slider body 20 to help eliminate any gaps between the top stop 10 and the flanges 38 of the slider body 20 and help eliminate gaps and create a better seal with the top wing 30 profile and the leading edge 36 of the slider body 20 as well so that the assembly is sealed from water penetration.

Top stop 10 also includes a plurality of holes 18 (FIGS. 1-3), through which a post or other suitable structure may pass to hold the tape 50 in place relative to the mold for forming the top stop 10. As mentioned above, the top stop 10 may be attached to the tape 50 such that the space between the two sides of the tape is smaller than with conventional top stops.

As discussed in detail above, top stop 10 is configured to cooperate with slider body 20 by engaging the front 28 of the slider body 20 (FIG. 7) and the connecting neck 42 of the slider body 20. Specifically, gap 17 formed within top stop 10 accommodates the front 28 of the slider body 20 and the connecting neck 42 of the slider body 20 and is configured so that connecting neck 42 is snuggly received within it. In this way, the shape and width W of the gap 17 is determined by the shape and width of the connecting neck 42. In some embodiments, the width W of the gap 17 is only slightly larger than the width of the connecting neck 42 (e.g., the width W of the gap 17 is the same as the width of the connecting neck 42 plus a minimal amount of clearance). When the slider assembly is in the engaged position, the connecting neck 42 is received within gap 17 and lip 56 compresses around the leading portion 58 of the connecting neck 42 due to lip 56 being relatively thin and therefore compressible. This compression around the connecting neck 42 eliminates any gaps between the top stop 10 and the connecting neck 42 that may arise due to variances in the shape of the lip 56, the connecting neck 42 or its leading portion 58, and/or other portions of the slider body 20. As such, the ledges 65 and the proximal ends 27, 29 (FIG. 1) of extensions 14, 16 outline the connecting neck 42 and prevent water from penetrating into the slider body 20, as shown in FIG. 16.

When the slider assembly is in the engaged position (FIG. 17), the slider body 20 forms a positive lock with the top stop 10. The configuration of the extensions of the top stop is such that an indicator (such as an audible snapping sound or other indicator) is provided as the slider assembly moves into its engaged position. In some versions, the length, height, and shape of the extensions 14, 16, including the presence and configuration of sliding surfaces 60, 62, and/or 63 helps secure the slider body 20 in the locked position and the surfaces 66 and 68 (FIG. 16) helps prevent the slider body 20 from disengaging with the top stop 10 under certain loads. The indicator, which is provided contemporaneously with the slider assembly moving into its engaged position, informs a user that the assembly is in its locked position.

Top stop 10 may be used with any type of zipper such as injection molded zippers, coil zippers, or metal fasteners. Top stop 10 may be used with any suitable product, including, but not limited to, clothing, bags, pockets, chemical protection suits, wet and dry suits, and/or outdoor clothing and gear. Because the top stop prevents water from penetrating gaps between the top stop 10 and the slider body 20, an additional flap or covering or piece of clothing is not necessary to cover the top stop portion of the zipper.

Numerous modifications of this invention may be made in the composition, application, manufacturing process and other aspects of this invention without departing from the objectives and spirit of the description above and in the Figures.

The invention claimed is:

1. A slider assembly comprising:

(a) a slider body comprising a top wing and a bottom wing that are spaced apart from one another and joined by a connecting neck, wherein each of the top and bottom wings comprises a leading edge that extends along a front of the slider body; and (b) a top stop comprising:

a body comprising a fin that projects upwardly from the body and that extends generally from a left side to a right side of the body, wherein the fin is formed of a flexible material and comprises a contour that generally conforms to the leading edge of the slider body;

a gap that mirrors the connecting neck of the slider body and that is configured to receive the connecting neck of the slider body; and two extensions that project from the body and extend beyond the gap, wherein a first of the two extensions projects beyond an edge of a second of the two extensions and wherein the two extensions are separated from one another at their distal ends by a width that is less than a width of the gap, wherein the top and bottom wings do not extend beyond the connecting neck.

2. The slider assembly of claim 1, wherein at least one of the two extensions comprises a first sliding surface and a second sliding surface, wherein a slope of the second sliding surface is greater than a slope of the first sliding surface.

3. The slider assembly of claim 2, wherein a bend is formed between the first and second sliding surfaces.

4. The slider assembly of claim 1, wherein the slider assembly is configured to produce an audible snapping sound as the connecting neck is received within the gap.

5. The slider assembly of claim 1, wherein the contour of the top stop contacts the connecting neck of the slider body and at least one of the leading edges of the top and bottom wings of the slider body.

6. The slider assembly of claim 1, wherein the top stop is formed of silicone or polyurethane.

7. The slider assembly of claim 6, wherein the top stop has a durometer hardness of about 20A to about 95A.

8. The slider assembly of claim 1, wherein the gap comprises a lip that generally conforms to a leading portion of the connecting neck of the slider body.

9. A top stop comprising:

a body comprising a fin that extends upwardly from the body and that extends laterally across the body, wherein the fin is formed of a flexible material and comprises a contour that generally conforms to a leading edge of a slider body;

a gap dimensioned to receive a connecting neck that extends between a top wing and a bottom wing of the slider body, wherein a lip of the gap generally conforms to a leading portion of the connecting neck and wherein the dimensions of the gap mirror dimensions of the connecting neck plus a clearance;

two extensions that project from the body of the top stop beyond the gap, wherein a first of the two extensions projects beyond an edge of the second of the two extensions and wherein at least one of the two extensions comprises two sliding surfaces, wherein one of the sliding surfaces has a greater slope than the other of the sliding surfaces and wherein the sliding surfaces are configured such that an audible sound is produced upon the connecting neck being received within the gap.

10. The top stop of claim 9, wherein the top stop is formed of silicone or polyurethane.

11. The top stop of claim 10, wherein the top stop has a durometer hardness of about 20A to about 95A.

12. The top stop of claim 9, further comprising a bend between the two sliding surfaces.

13. The top stop of claim 9, wherein the top stop is formed of a flexible material.

14. A slider assembly comprising:

(a) a slider body comprising a top wing and a bottom wing that are spaced apart from one another and joined by a connecting neck, wherein each of the top and bottom wings comprises a leading edge that extends along a front of the slider body; and (b) a top stop comprising:

a body comprising a fin that projects upwardly from the body and that extends generally from a left side to a right side of the body, wherein the fin is formed of a flexible material and comprises a contour that generally conforms to the leading edge of the slider body;

a gap that mirrors the connecting neck of the slider body and that is configured to receive the connecting neck of the slider body; and two extensions that project from the body and extend beyond the gap, wherein a first of the two extensions projects beyond an edge of a second of the two extensions and wherein the two extensions are separated from one another at their distal ends by a width that is less than a width of the gap, wherein the slider assembly is configured to produce an audible snapping sound as the connecting neck is received within the gap.

* * * * *